US006561792B1

(12) United States Patent
Pfund

(10) Patent No.: US 6,561,792 B1
(45) Date of Patent: May 13, 2003

(54) ADJUSTABLE ELECTRODE FOR OIL BURNERS

(76) Inventor: Albert G. Pfund, 1 Sawmill La., Asbury, NJ (US) 08802

( * ) Notice: Subject to any disclaimer, the term of this patent is extended or adjusted under 35 U.S.C. 154(b) by 0 days.

(21) Appl. No.: 10/098,675

(22) Filed: Mar. 14, 2002

(51) Int. Cl.[7] ..... F23Q 3/00
(52) U.S. Cl. ..... 431/264; 431/256
(58) Field of Search ..... 431/264, 256, 431/258, 265, 266

(56) References Cited

U.S. PATENT DOCUMENTS 2,135,296 A * 11/1938 Towne
2,498,823 A * 2/1950 Peterson
2,656,615 A * 10/1953 Rowell
2,896,334 A * 7/1959 Dunderman
4,071,800 A 1/1978 Atkins
4,081,233 A 3/1978 Kitajima et al.
4,431,240 A * 2/1984 Riehl
4,464,108 A 8/1984 Korenyi
4,472,136 A 9/1984 Lefebvre
4,487,571 A 12/1984 Robertson et al.
4,791,734 A 12/1988 Wojtkowiak
5,073,741 A 12/1991 Suzuki et al.

* cited by examiner

*Primary Examiner*—Alfred Basichas
(74) *Attorney, Agent, or Firm*—Kenneth P. Glynn, Esq.

(57) ABSTRACT

The present invention is directed to an adjustable electrode for oil burners. This electrode includes an elongated main electrode, an electrode tip support member and an electrode tip. The elongated main electrode has a conductive core element and has an outer end and an inner end. The inner end is adapted for connection to an electrical path of a source of electrical power, and the outer end has an electrode tip support member conductively connected to it. The support member has a central axis and has an electrode tip-receiving orifice therethrough at a predetermined angle relative to the central axis. Additionally, the support member has a locking mechanism for locking the elongated electrode tip in the orifice and for unlocking the elongated electrode tip for adjustment in and removal from the orifice. The locking mechanism may be a set screw, spring, swing lever or other locking mechanism. The midsection of the main electrode advantageously has an insulative outer layer for electrical protection in the mounting arrangement.

20 Claims, 4 Drawing Sheets

ADJUSTABLE ELECTRODE FOR OIL BURNERS

BACKGROUND OF THE INVENTION

1. Field of the Invention

The present invention relates to oiling burning heating devices commonly known as oil burners, and more particularly to adjustable electrodes for oil burner ignition systems. The present invention electrodes are adjustable relative to one another for gap setting and resetting of gaps, and are adjustable for loss compensation of electrode tips due to burn out over time.

2. Information Disclosure Statement

The following patents are representative of the state of the art as to oil burner combustion systems specifically, and electrodes in general:

U.S. Pat. No. 4,071,800 describes a three electrode plasma flame ignition device, the first electrode surrounds the second electrode and the first and second electrodes define between them an annular gap across which the potential from a first source can be discharged, and the third electrode is surrounded by the second electrode and is so arranged that a higher potential applied to it discharges in series across a gap between the third electrode and the second electrode and radially across the annular gap between the second electrode and the first electrode.

U.S. Pat. No. 4,081,233 describes a combustion device of the type for atomizing liquid fuel by an ultrasonic atomizer and mixing the atomized fuel particles with air for combustion. A first air passage is defined around a horn of the ultrasonic atomizer by an inner cylinder, and a second air passage is defined around the first air passage by the inner cylinder and an outer cylinder. The air flowing through the first air passage is discharged into a cylindrical combustion section substantially in parallel with the axis thereof while the air flowing through the second air passage is swirled in the direction substantially tangential to the inner wall of the combustion section and discharged toward the atomizing surface of the horn, whereby the satisfactory mixing of the atomized fuel particles with the combustion air may be attained and the flame may be optimally stabilized.

U.S. Pat. No. 4,464,108 describes a combustion apparatus having an ignition means, a plurality of first swirl vanes positioned at the upstream end of a flame retention head creates a helical primary air/fuel mixture in the combustion chamber of the retention head that ignites into a primary flame vortex. A second plurality of vanes mounted on the inner walls of the retention head shears the outer portions of the primary flame vortex into a plurality of secondary helical flame vortexes disposed about the perimeter of the primary flame vortex. The secondary flame vortexes are opposite in rotational orientation to the direction of rotation of the primary flame vortex. Secondary air is injected into the combustion chamber at the area of shearing.

U.S. Pat. No. 4,472,136 describes a four-stage flame retention head assembly for use in the air pipe of a fuel burner having a fuel nozzle mounted coaxially within the air pipe. This assembly comprises an outwardly diverging flame retention head mounted in the air pipe in front of the fuel nozzle. This head successively defines, starting from its smaller end, an air-and-fuel mixture chamber; a first inwardly open expansion chamber; a throttle section and an outwardly convex section defining a second expansion chamber. A primary air inlet annular plate is mounted transversely at the inlet end of the head and has a central opening circumscribed by a continuous annulus. The latter has a series of air inlet apertures and louvers over the apertures, the latter and the louvers causing swirling of the air as it enters into the mixing chamber. The first and the second expansion chambers are provided with circumferentially spaced air apertures to pass air into the retention head to sustain combustion therein as well as to cool the head.

U.S. Pat. No. 4,791,734 describes a tool for setting the width of a space between the tips of a pair of burner ignition electrodes so that an electrical spark will jump this gap, and the axial and radial distances of these tips forward of the center of a fuel nozzle outlet so that fuel discharged by the nozzle will be ignited smoothly and will not cause carbon deposits to build up on the tips. The nozzle is removably threaded in a threaded opening of a fuel supply pipe and is replaced by the tool during the setting operation. The tool has a threaded shank and a stop flange for supporting and positioning an annular groove of the tool so as to receive and set the ends of the electrode tips in the correct position. The groove is in an annular face formed by a shoulder of the tool and has an annular face formed by a shoulder of the tool and has an outer wall for holding the ends of radially extending electrode tips in the groove as the tool is rotated into a seated position in the fuel supply pipe opening.

U.S. Pat. No. 4,487,571 describes an oil combustion system for burning waste oil in which oil is pumped by an oil transfer pump from an oil reservoir through a buoyant swirling filter. The oil is supplied to a high pressure input of a pressure reducing fitting, and is transmitted through the fitting to a low pressure output and a high pressure output. A siphon nozzle head is operable to siphon the oil from the low pressure output of the fitting, to preheat the oil, to atomize the oil and to output the atomized oil. Retention chambers and heat transfer plugs within the nozzle head facilitate preheating of the oil and perform a baffle function.

U.S. Pat. No. 5,073,741 describes an igniter plug that has a tubular metallic shell and an annular ground electrode each connected in a series by an interfitting, and fixed by welding. The igniter plug further has a tubular insulator placed within both the metallic shell and the ground electrode, while a center electrode is placed within the insulator to be surrounded by the ground electrode. A plurality of lock arms are provided with a front end of the metallic shell, and each top end of lock arms has a pawl which is brought into an engagement with an inner surface of the ground electrode when the metallic shell and the ground electrode are connected, and at the same time, the insulator is brought into an engagement with an inner side of each lock arm to deter the lock arms from being flexed inwardly when the insulator is placed.

Notwithstanding the prior art, the present invention is neither taught nor rendered obvious thereby.

SUMMARY OF THE INVENTION

The present invention is directed to an adjustable electrode for oil burners. This electrode includes an elongated main electrode, an electrode tip support member and an electrode tip.

The elongated main electrode has a conductive core element and has an outer end and an inner end. The inner end is adapted for connection to an electrical path of a source of electrical power, and the outer end has an electrode tip support member conductively connected to it. The support member has a central axis and has an electrode tip-receiving orifice therethrough at a predetermined angle relative to the central axis. Additionally, the support member has a locking mechanism for locking the elongated electrode tip in the orifice and for unlocking the elongated electrode tip for adjustment in and removal from the orifice.

In some preferred embodiments of the present invention adjustable electrode, the elongated main electrode includes a midportion insulator that surrounds it. This insulator may be cylindrical for ease of installation of the electrode.

The elongated main electrode itself may have any cross sectional, configuration or combination of configurations, although cylindrical and flat stock is commonly used for electrodes. In one preferred embodiment, the main electrode is a flat sheet electrode, and this affords a flat inner end for plug, clip or slide in connection to the electrical power supply wiring or path. In other embodiments, the electrode inner end may be adapted for direct wiring rather than for connection to a fixed connector.

The present invention adjustable electrode for oil burners has a support member locking mechanism that may utilize any known or available locking mechanism, including, but not limited to, a swivel latch, a set screw locking mechanism, a cam-based locking mechanism, or a spring-based locking mechanism.

While the support member for the electrode tip, in preferred embodiments, is connected directly to said outer end of said elongated main electrode, there could be conductive intermediary fittage, without exceeding the scope of the present invention, although direct, physical contact and assemblage is preferred.

The electrode tips of the present invention are electrode rods of predetermined length adapted to be removably mounted within the support member and are made of any appropriate conductive electrode material, such as nickel-silver electrode alloy, and may be of any appropriate size for the application, e.g., 0.080 inch diameter stock. Other sizes and materials of construction are within the purview of the artisan.

The present invention is also directed to an oil combustion system for oil burners. It includes: (1) an oil inlet for connection to an oil supply; (2) a pump connected upstream to the oil inlet and downstream to an oil spray mechanism and nozzle; (3) an oil spray mechanism and nozzle connected to the pump and adapted to spray oil in a predetermined pattern for combustion; (4) a pair of adjustable electrodes having a spark gap therebetween and being located adjacent the nozzle for providing a spark for ignition and combustion of oil sprayed from the nozzle, each of the pair of adjustable electrodes being as described above.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Oil burners employ a nozzle at the end of a fuel supply pipe to atomize liquid fuel oil and provide a diverging spray of small fuel oil droplets which can be readily ignited and burned. The atomized spray is ignited by a pair of electrodes having tips or points, the ends of which are spaced apart to provide a spark gap. The electrodes are connected to a source of electrical power which produces an ignition spark when the gap is jumped by an electric current.

The width of the spark gap and the positioning of this gap relative to the atomized spray are critical. The width of the spark gap must be such that the electric current will jump the gap under the conditions at which the burner operates. For example, the gap width must provide a strong spark in the turbulent air currents caused by the fuel spray and each electrode must be positioned to prevent sparks from jumping to any other metal parts. The electrode tips also remain out of the path of the spray droplets by a distance sufficient to prevent the formation of carbon deposits, but sufficiently close to the spray to ensure ignition of the fuel. If a failure of ignition results from an improper size or location of the gap, fuel may continue to enter the combustion chamber where an accumulated amount of liquid fuel may itself cause damage or be subsequently ignited with undesirable consequences, such as distribution of soot and/or fumes beyond the confines of the combustion chamber. In addition, through extended use, these electrodes burn out, shorten from the burnout, and must be replaced.

Figure 1:
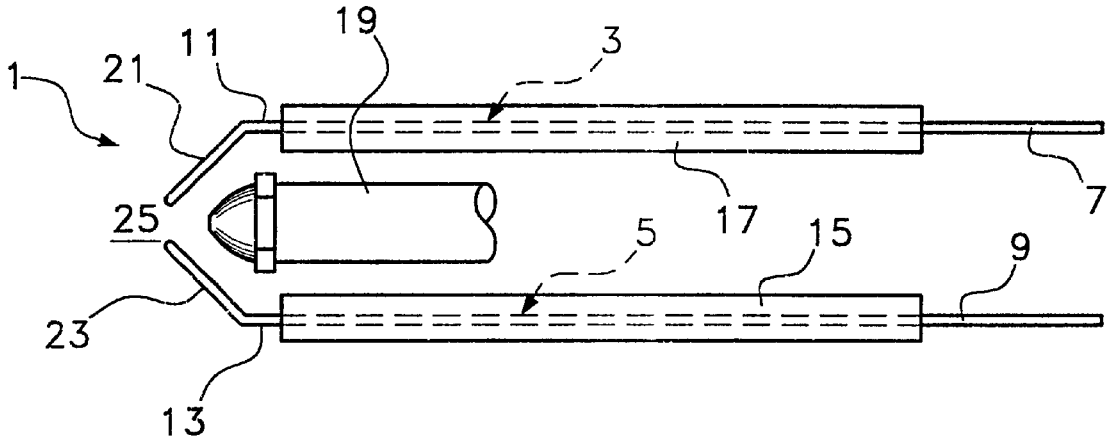
Fig. 1 (Prior Art)
FIG. 1 illustrates a prior art oil burner combustion nozzle and electrode pair.

FIG. 1 shows a prior art combustion system 1 (in part) for oil burners in a top view. It includes a pair of conventional oil burner electrodes 3 and 5 with inner ends 7 and 9 (connected to an electrical power supply (not shown) and outer ends 11 and 13. Outer ends 11 and 13 have electrode tips 21 and 23 set at about 230 degrees from the outer ends 11 and 13, and spaced apart a predetermined distance to create a spark gap 25. This spark gap 25 is functionally located in front of oil spray mechanism 19 so as to ignite sprayed oil during operation, within the context of an oil burner. The electrodes have cylindrical insulators 15 and 17 for mounting in a non-conductive fashion.

As can be seen from FIG. 1, the electrode tips 21 and 23 are fixed in distance apart, as well as fixed in their lengths. Hence, when these tips are burnt down from usage overtime, they are shortened and eventually, the gap becomes too great to function properly. Because of the fixed lengths of the tips, when partial burn down occurs, the entire electrode must be replaced. This is costly and time consuming. The cost of replacement may range from a few dollars to thirty or forty dollars depending upon the size and model. Slide length of the electrodes must be determined and set to establish the correct distance forward from oil spray mechanism and the correct gap must be set, each time the electrodes are replaced. In addition to parts costs, there is a correlating labor cost involved as well.

The present invention eliminates the foregoing problems by decreasing parts costs to a few cents, decreasing labor, eliminating the need to replace the entire electrodes and substantially reducing replacement frequency and electrode slide length adjustment.

Figure 2:
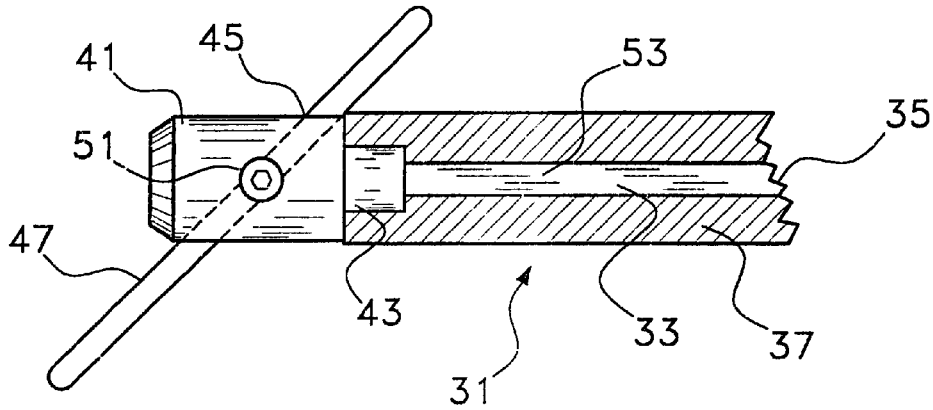
FIG. 2 shows a present invention adjustable electrode for oil burners.

FIG. 2 illustrates one preferred embodiment of a present invention adjustable electrode in a top, partially cut, view. Here, present invention electrode 31 includes a main elongated electrode 33, an inner end (cut end 35) similar to that of conventional inner ends, e.g. as described in conjunction with FIG. 1, above, and an outer end 53. Main electrode 33 also has an insulator 33 similar to the FIG. 1 electrode insulator. An outer end 53, there is attached an electrode tip support member 41, with an orifice 45 for receiving electrode tips 47 and an attachment to main electrode outer end 53. (This may be done by any known technique of metal-to-metal assemblage, e.g. threading, welding, force, fitting, etc.)

Support member 41 also has a second orifice in its top, which is threaded and contains set screw 51. This set screw and threaded orifice compromise a locking mechanism for locking and unlocking electrode tips 47 in position. While its angle is fixed, as shown, the protruding length of tip 47 is adjustable. Hence, using set screw 51 and moving the electrode tip 45 as desired, an original gap set may be achieved, and, after some of the tips 47 is burnt off through prolonged usage, it may be adjusted to original protrusion length and gap. Thus, the present invention adjustable electrodes enable quick, accurate correction of shortened burn-out electrode problems without the need for more expensive and more labor intensive electrode replacement. Eventually, the present invention electrode tips themselves are shortened from burn out and cannot be extended further. They are simply replaced with new tips, again without the need for entire electrode assembly replacement.

Additionally, while the set screw 51 and its threaded orifice are shown as located in the top of support member 41 and are shown at right angles to the central axis of the electrode, these could be located in any position and at any angle desired as long as they remain functional.

FIGS. 3, 4, 5 and 6 all show alternative embodiment present invention electrodes with variations in the electrode tip locking mechanisms. Otherwise, all of the component parts which are identified to those shown in FIG. 1 and, identically numbered and need not be repeated here.

Figure 3:
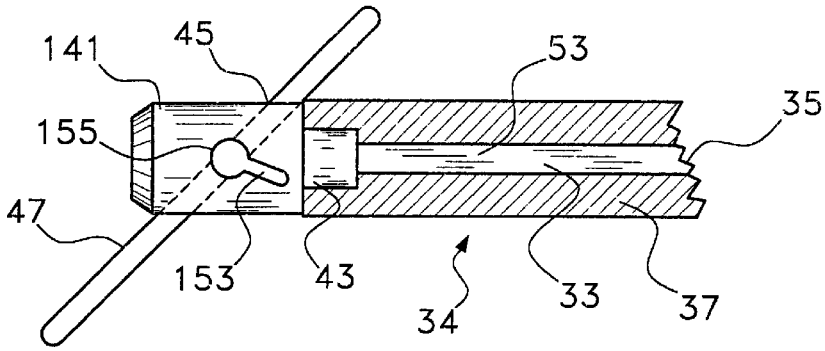
FIGS. 3, 4, 5, 6, and 7 show alternatives embodiments of present invention adjustable electrodes for oil burners.

FIG. 3 shows a present invention adjustable electrode 34 with swing lever 153 with a screwed in pivot 155, which locks and unlocks electrode tip 47.

Figure 4:
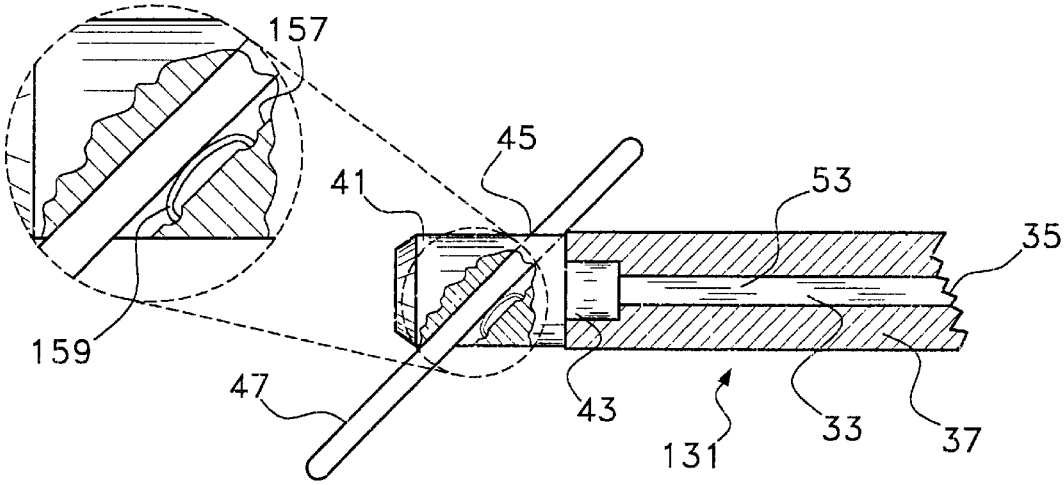

FIG. 4 shows a present invention adjustable electrode 131 with a leaf spring 159 positioned in opening 157 for pressure against tip central area 161. In this embodiment the user is not required to tighten or untighten a lever or screw or the like, because the spring 159 is under sufficient tension to hold the tip 47 in place. A user will be required to overcome the force of the spring to move the tip into a new position. The spring may be of sufficient tension to be overcome by manual push or stronger to require tapping or pulling with a tool.

Figure 5:
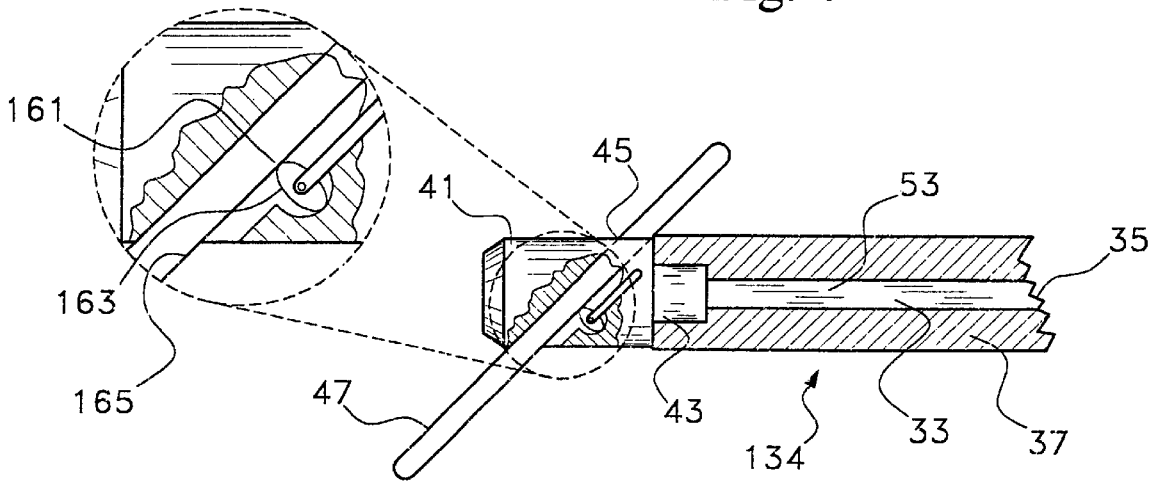

In FIG. 5, shows a present invention adjustable electrode 134 wherein a cam action lever 165 is used to rotate cam 163 to engage (lock) and disengage (unlock) electrode tip 47 at area 161.

Figure 6:
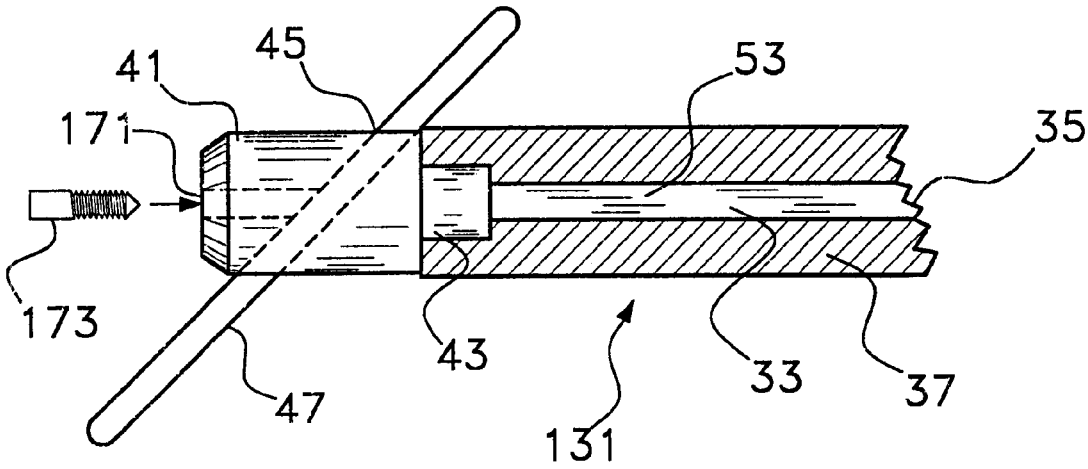

In FIG. 6, present invention adjustable electrode 181 includes a set screw 173 which is inserted into front end central orifice 171 for locking and unlocking tip 47. Note that the screw head of set screw 173 is angled to coincide with the angle of tip 47 to create surface-to-surface contact rather than point-to-surface contact for enhanced engagement.

Figure 7:
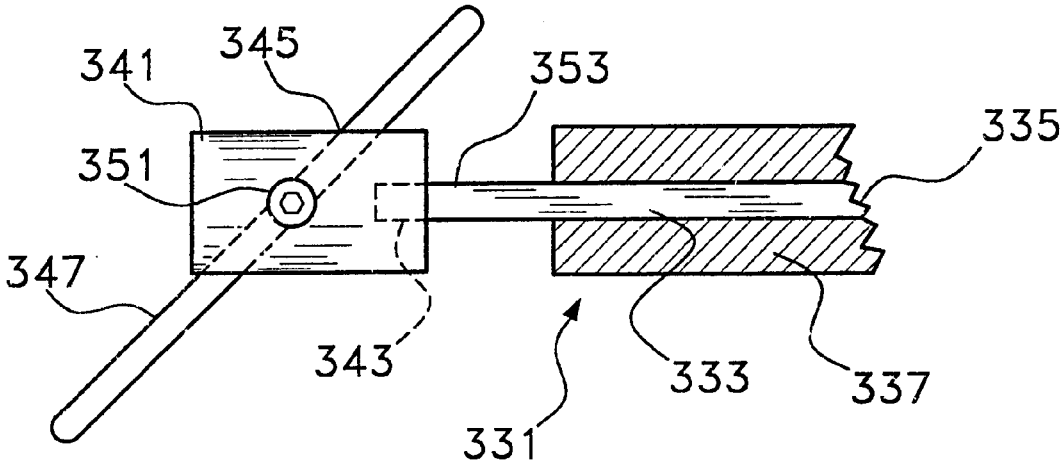

In FIG. 7, present invention adjustable electrode 331 has a main electrode 333 with a truncated inner end 335, insulator 337 and outer end 353. Attached to outer end 353 is a block 341 which includes a receiving inset 343 for attachment to the outer end 353. This block is in line with main electrode 333, but could be angled or secured differently, and tip-receiving orifice 345 would be angled differently to create the desired angle between tip 347 and main electrode 333. Set screw 351 is used to lock and unlock tip 347. As can be seen from this Figure, variations in types of support members and positions may be used in exceeding the scope of the present invention.

Figure 8:
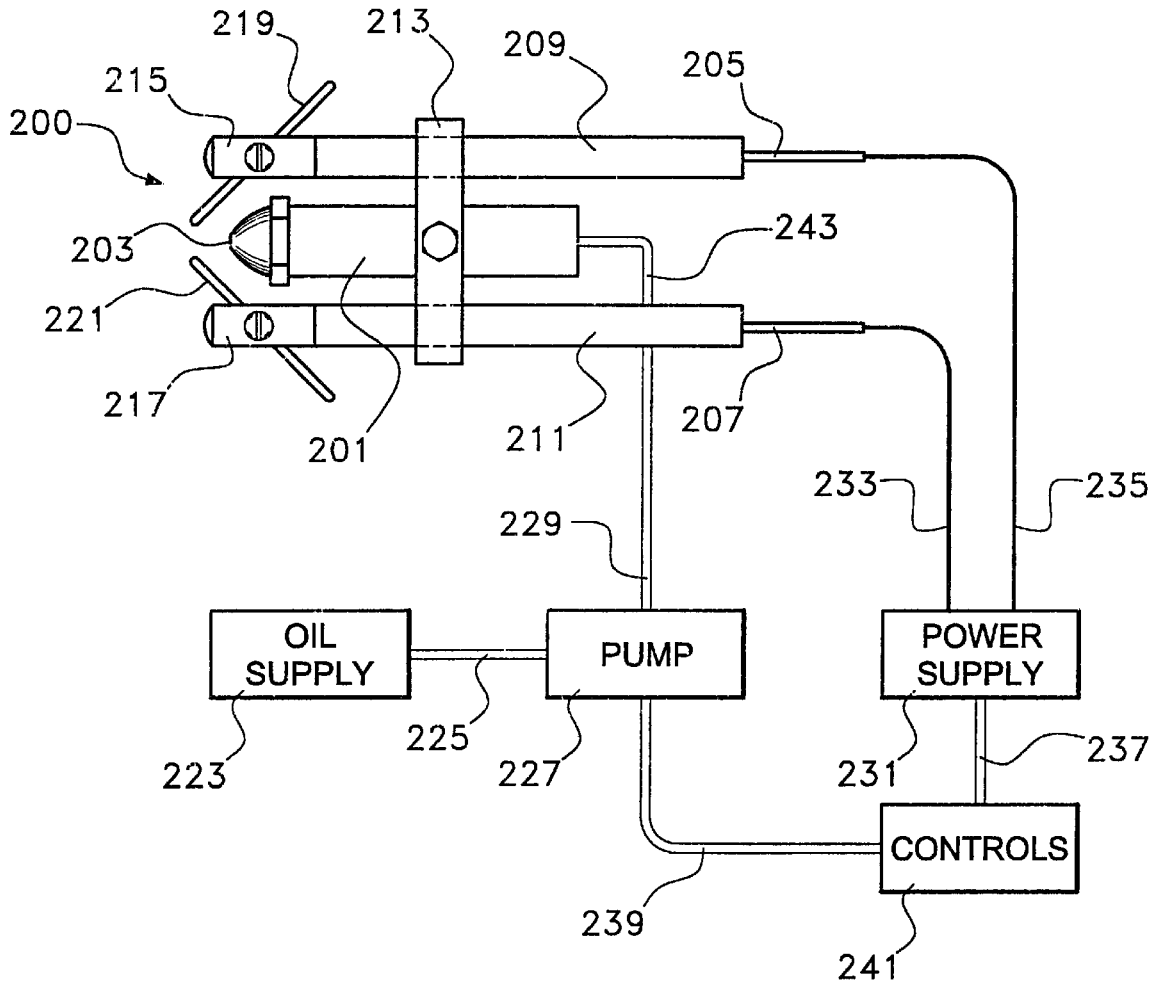
FIG. 8 illustrates a present invention oil combustion system for oil burners.

FIG. 8 shows a top view of a present invention combustion system 200 for oil burners. There is an oil spray mechanism 201 and spray nozzle 203 and two main electrodes with insulators 209 and 211, inner ends 205 and 207 are outer ends with electrode support members 215 and 217 with set screw-type locks, which secure electrode tips 219 and 221, as described in conjunction with FIG. 2 above.

Inner ends 205 and 207 are connected via electric lines 235 and 233, respectively to power supply 231. Power supply 231 is connected 237 to controls 241, which itself is also connected 239 to pump 227. Oil supply 223 is connected via line 225 to pump 227, and, when the system is activated by controls 241, pump 227 pump[s oil via line 243 to oil sprayer mechanism 201. Here the oil is sprayed through the nozzle 203, which is ignited by sparking from present invention adjustable electrode tips 219 and 221. This system has a more efficient and long term less costly ignition arrangement than the prior art systems, with all of the advantages set forth above.

Obviously, numerous modifications and variations of the present invention are possible in light of the above teachings. For example, while the present invention is directed to the adjustable electrodes for oil burners, the electrodes may be used in other embodiments wherein a fuel is combusted. This could be in the context of liquid or gaseous fuels and could even be used in units other than heating units, such as cooking units and starter systems for combustible fuels. It is, therefore, understood that within the scope of the appended claims, the invention may be practiced otherwise than as specifically described herein.

What is claimed is:

1. An adjustable electrode for oil burners, which comprises:

(a) an elongated main electrode, having a conductive core element and having an outer end and an inner end, said inner end adapted for connection to an electrical path of a source of electrical power;

(b) an electrode tip support member conductively connected to said outer end of said elongated main electrode, said support member having a central axis and having an electrode tip-receiving orifice therethrough at a predetermined angle relative to said central axis, said support member having a locking mechanism for locking an elongated electrode tip in said orifice and for unlocking an elongated electrode tip for adjustment in and removal from said orifice;

(c) an elongated electrode tip positioned within said orifice.

2. The adjustable electrode for oil burners of claim 1 wherein said elongated main electrode includes a midportion insulator that surrounds said electrode.

3. The adjustable electrode for oil burners of claim 1 wherein s aid elongated main electrode is a flat sheet electrode.

4. The adjustable electrode for oil burners of claim 2 wherein said insulator has a cylindrical outer configuration.

5. The adjustable electrode for oil burners of claim 3 wherein said insulator has a cylindrical outer configuration.

6. The adjustable electrode for oil burners of claim 1 wherein said support member locking mechanism is a swivel latch.

7. The adjustable electrode for oil burners of claim 1 wherein said support member locking mechanism is a set screw locking mechanism.

8. The adjustable electrode for oil burners of claim 1 wherein said support member locking mechanism is a cam-based locking mechanism.

9. The adjustable electrode for oil burners of claim 1 wherein said support member locking mechanism is a spring-based locking mechanism.

10. The adjustable electrode for oil burners of claim 1 wherein said support member is connected directly to said outer end of said elongated main electrode.

11. An oil combustion system for oil burners, which comprises;

(1) an oil inlet for connection to an oil supply;

(2) a pump connected upstream to said oil inlet and downstream to an oil spray mechanism and nozzle;

(3) an oil spray mechanism and nozzle connected to said pump and adapted to spray oil in a predetermined pattern for combustion;

(4) a pair of adjustable electrodes having a spark gap therebetween and being located adjacent said nozzle for providing a spark for ignition and combustion of oil sprayed from said nozzle, each of said pair of adjustable electrodes including:

(a) an elongated main electrode, having a conductive core element and having an outer end and an inner end, said inner end adapted for connection to an electrical path of a source of electrical power;

(b) an electrode tip support member conductively connected to said outer end of said elongated main electrode, said support member having a central axis and having an electrode tip-receiving orifice therethrough at a predetermined angle relative to said central axis, said support member having a locking mechanism for locking an elongated electrode tip in said orifice and for unlocking an elongated electrode tip for adjustment in and removal from said orifice;

(c) an elongated electrode tip positioned within said orifice.

12. The oil combustion system for oil burners of claim 11, wherein, for each of said adjustable electrodes, said elongated main electrode includes a midportion insulator that surrounds said electrode.

13. The oil combustion system for oil burners of claim 11, wherein, for each of said adjustable electrodes, said elongated main electrode is a flat sheet electrode.

14. The oil combustion system for oil burners of claim 12, wherein, for each of said adjustable electrodes, said insulator has a cylindrical outer configuration.

15. The oil combustion system for oil burners of claim 13, wherein, for each of said adjustable electrodes, said insulator has a cylindrical outer configuration.

16. The oil combustion system for oil burners of claim 11, wherein, for each of said adjustable electrodes, said support member locking mechanism is a swivel latch.

17. The oil combustion system for oil burners of claim 11, wherein, for each of said adjustable electrodes, said support member locking mechanism is a set screw locking mechanism.

18. The oil combustion system for oil burners of claim 11, wherein, for each of said adjustable electrodes, said support member locking mechanism is a cam-based locking mechanism.

19. The oil combustion system for oil burners of claim 11, wherein, for each of said adjustable electrodes, said support member locking mechanism is a spring-based locking mechanism.

20. The oil combustion system for oil burners of claim 11, wherein, for each of said adjustable electrodes, said support member is connected directly to said outer end of said elongated main electrode.

* * * * *